United States Patent [19]

Ciongwa et al.

[11] 4,394,867

[45] Jul. 26, 1983

[54] SUCTION ARRANGEMENT IN A BOTTLE-CLEANING MACHINE FOR REMOVING OF LABELS FROM BOTTLES

[75] Inventors: Joachim Ciongwa; Werner Heckmann, both of Dortmund; Klaus Jendrichowski, Holzwickede; Karl Quest, Dortmund; Christian Rüppell, Unna; Wolfgang Süshardt, Dortmund, all of Fed. Rep. of Germany

[73] Assignee: Holstein und Kappert GmbH, Dortmund, Fed. Rep. of Germany

[21] Appl. No.: 275,514

[22] Filed: Jun. 15, 1981

[51] Int. Cl.[3] ..... B08B 15/00

[52] U.S. Cl. ..... 134/104; 134/154

[58] Field of Search ..... 134/104, 154

[56] References Cited

U.S. PATENT DOCUMENTS

| | | | |
|---|---|---|---|
| 3,162,204 | 12/1964 | Babunovic et al. | 134/104 X |
| 3,868,960 | 3/1975 | Cove et al. | 134/104 X |
| 3,946,750 | 3/1976 | Fischer et al. | 134/104 |
| 4,103,698 | 8/1978 | Richardson et al. | 134/104 X |

*Primary Examiner*—Robert L. Bleutge
*Attorney, Agent, or Firm*—Michael J. Striker

[57] ABSTRACT

A suction arrangement for removing labels from bottles comprising a label-softening container adapted to contain a liquid, a plurality of elongated bottle-receiving cells having each an open end for insertion and withdrawal of bottles into and from the cell and provided at its opposite end with a plurality of openings, a conveyor for transporting the cells closely adjacent each other and closely past an opening in a bottom portion of a wall defining a suction compartment within the container while liquid is continuously sucked out of the suction compartment and returned into the container so that a stream of liquid passes from the container through that cell which is located at any instant adjacent the opening in the bottom portion of the wall defining the suction compartment to thus remove the labels from the bottles and transport the labels through the opening into the suction compartment while transversely spaced bars extend in the suction compartment over the opening to prevent the bottles to pass together with the labels out of their cells.

7 Claims, 4 Drawing Figures

SUCTION ARRANGEMENT IN A BOTTLE-CLEANING MACHINE FOR REMOVING OF LABELS FROM BOTTLES

BACKGROUND OF THE INVENTION

Cleaning machines for reusable food containers, such as bottles and the like, have, besides the actual cleaning of such containers, the task to securely remove labels or the like from the containers. For this purpose, the bottles provided with the labels are, after a certain presoftening period, impinged by spray nozzles or the like with liquid.

In a known machine of this type, the bottles with the labels thereon are transported in bottle-receiving cell in loops through the machine whereby in the respective lower transition region of the loop are troughs arranged into which the labels are washed off from a station arranged above the troughs. However, these known arrangements do not always assure a positive removal of the labels from the bottles, especially since part of the labels will remain suspended on the conveyor and carried by the latter into following baths. In addition, in this known arrangement the bottles do not change their position during the removal of the labels, whereby the labels may be clamped in the cells at points where the bottles abut against the respective cells and thus be not properly removed from the bottles.

SUMMARY OF THE INVENTION

It is an object of the present invention to overcome the disadvantage of such known arrangements for removing of labels from bottles.

It is a further object of the present invention to provide a suction arrangement for removing labels from bottles which will assure that the removed labels will not cling to any guide elements of the arrangement.

With these and other objects in view, which will become apparent as the description proceeds, the suction arrangement according to the present invention for removing labels from bottles passing through a bottle-cleaning machine mainly comprises a label-softening container adapted to contain a liquid, a plurality of elongated bottle-receiving cells each having an open end for insertion of bottles with labels into the cell and for withdrawing the bottles after the labels have been removed therefrom, said bottle-receiving cells each having opposite said open end a plurality of openings for the passage of liquid into the cells, conveyor means for transporting the cells with bottles inserted therein through the label-softening container, means for causing a stream of liquid from the softening container to pass, at a point of transporting the cells through the label-softening container, from said container through said openings in said opposite ends of the cells, through the latter and to leave through said open end to detach the labels from the bottles and to remove the labels through said open ends, and means at said point of transporting of said cells for preventing the bottles from leaving the container through the open ends under the influence of the stream of liquid passing therethrough.

The aforementioned means for causing a stream of liquid from the label-softening container to pass through the cells comprise wall means defining a suction compartment within the label-softening container and having a bottom portion upwardly spaced from the bottom wall of the latter and being formed in the bottom portion with a single opening having a width at least equal to the width of the open end of each cell, as considered in the direction of movement of the cells, and the conveyor means being arranged to transport the bottle-receiving cells with the open ends thereof closely adjacent the bottom portion of the wall means past the openings therein, while the means for causing a stream of liquid to pass through the cells further comprise means for sucking liquid from the suction compartment while discharging the liquid into the label-softening container so that as the cells pass the opening, liquid will flow in a stream through said openings at the opposite end of each cell and through the open end thereof to thus transport the loosened labels through said opening in said wall means into the suction compartment.

Preferably, each of the receiving cells has outwardly extending flanges surrounding the open end thereof of preferably rectangular configuration and the bottle-receiving cells are mounted on the conveyor means in such a manner that side edges of the flanges of each bottle-receiving cell abut against side edges of flanges on adjacent cells, so that these flanges form a substantially uninterrupted surface except for the open ends of these cells.

The means for preventing the bottles from leaving through the open ends of the cells comprise a plurality of transversely spaced bars mounted in the suction compartment extending in the transporting direction of the cells over the opening in the wall means, and the bars are preferably downwardly inclined in the transport direction of the cells.

The arrangement according to the present invention has the advantage that the bottles, as soon as they reach the opening in the wall means, are moved slightly upwardly and subsequently thereto again downwardly, so that the bottles will move within their cells in vertical direction, which is especially advantageous for the stripping off of the labels or for the loosening of any clamped label portions. In addition, due to the finger-like construction of the bars, any labels abutting thereagainst are stripped therefrom by the bottle-receiving cells or by the bottles therein.

The arrangement of the flanges around the open ends of the cells has the advantage that these flanges will form a surface interrupted only by the open ends of the cells which will assure that the stream of liquid passing from the softening container into the suction compartment will pass only through the cell, so that secondary streams or disturbing turbulence effects are avoided which could lead to an adhering of the loosened labels at undesired locations.

The arrangement according to the present invention therefore has the advantage that the stream of liquid passes only upwardly through the cell so that the labels are withdrawn by the relative intensive stream of liquid in upward direction, while the rods extending transversely spaced from each other in the suction compartment over the opening in the wall means will positively prevent movement of the bottles in the bottle-receiving cells into the suction compartment.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
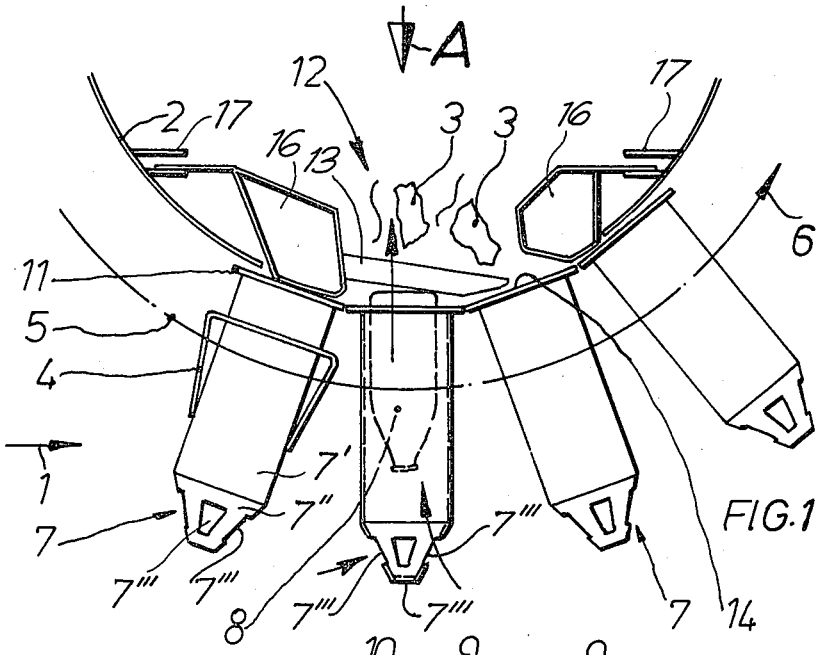
FIG. 1 is a vertical cross section through part of the suction arrangement according to the present invention.
Figure 2:
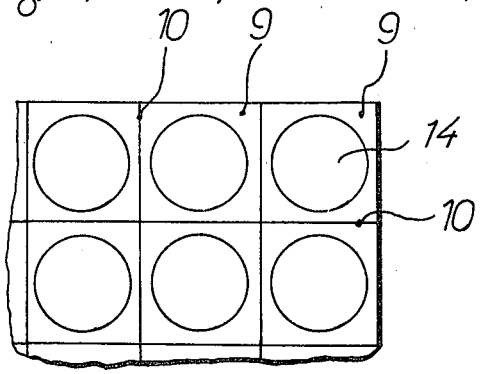
FIG. 2 is a top view of band-like arranged receiving cells.
Figure 4:
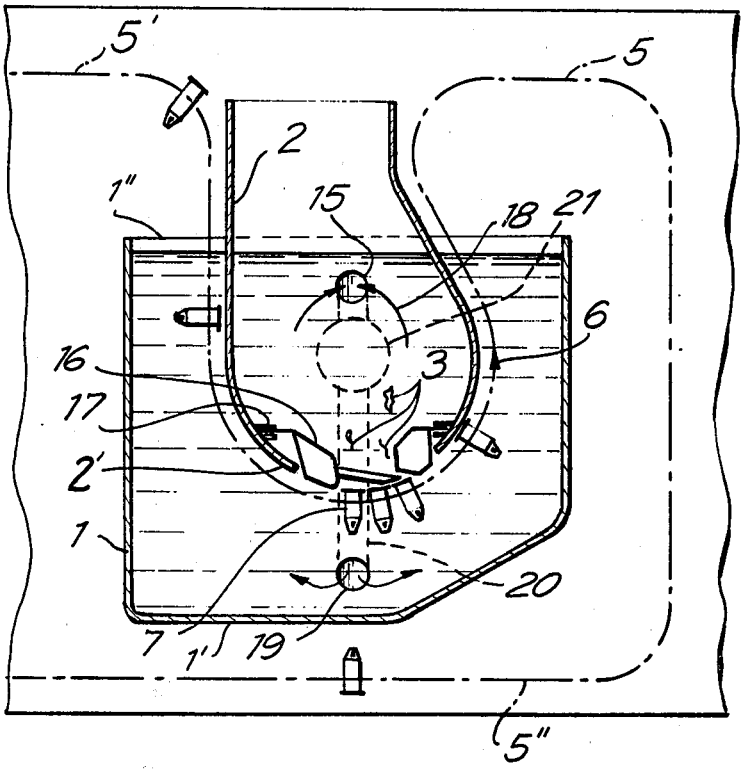
FIG. 4 is a schematic cross section of the complete suction arrangement.

Referring first to FIG. 4 which schematically illustrates the overall arrangement of the present invention, it will be seen that this arrangement comrises a label-softening container 1 having a bottom wall 1' and an upper open end 1" and being adapted to be filled up to a predetermined level with liquid, preferably a lye solution. Wall means 2 define within the label-softening container 1 a suction compartment having a bottom portion 2' formed with a single opening 12. A plurality of elongated bottle-receiving cells 7 are mounted by cell carriers 4 on a chain conveyor 5 schematically illustrated in FIGS. 1 and 4 and this chain conveyor 5 has, as shown in FIG. 4, an upper run 5' extending in horizontal direction above the upper open end 1" of the label-softening container 1 to pass then, as shown in FIG. 4, along the left portion of the wall 2 defining the suction compartment, beneath the bottom portion 2' of the wall means past the opening 12 therein and upwardly along the right portion of the wall means out of the label-softening container 1 and finally in downward direction to a lower horizontal run 5" of the conveyor beneath the bottom wall 1' of the label-softening container 1. The means for guiding the chain conveyor 5 in the direction of the arrow 6 along the aforementioned paths are for simplicity reason not shown in the drawing, and such means may comprise, as well known in the art, a plurality of guide rolls or the like. Each of the bottle-receiving cells 7, as best shown in FIG. 1, has an elongated cylindrical portion 7' having an open end 14 and opposite this open end a frustoconical portion 7" formed with a plurality of openings 7'''. The open end 14 of each bottle-receiving cell 7 is surrounded by an outwardly extending flange 9 of preferably rectangular or quadrangular outline, as best shown in FIG. 2, and the various bottle-receiving cells 7 are carried by their carriers 4 on the conveyor 5 in such a manner that side edges 10 of the flanges 9 abut against each other, as shown in FIG. 2, so that these flanges form a substantially continuous band 11 interrupted only by the openings 14 of the cells 7.

As shown in FIG. 4 a fluid outlet opening 15 is provided for instance in the rear wall of the suction compartment defined by the wall means 2 and a fluid inlet opening 19 is provided, for instance in the rear wall of the label-softening container 1, and the fluid outlet opening 15 is connected to the fluid inlet opening 19 by a conduit 20 in which a pump 21 is arranged for feeding fluid from the suction compartment into the label-softening container 1. The pump 21 may be constructed to produce a pulsating stream through the conduit 20, for instance the pump may be constructed as a single-acting piston pump or the like, whereby the level of liquid in the label-softening container 1 rises while the level of liquid in the suction compartment drops, and the thus produced hydrostatic pressure will produce a stream of liquid through the opening 7''' about the bottle 8 in the cells 7 and out of the open end 14 of the latter as the respective cell 7 passes the opening 12 of the bottom portion 2' of the wall means 2 defining the suction compartment, so that labels 3, already softened during their passage through the softening container 1, are detached from the bottles 8 and transported through the open end 14 of the respective cell into the suction compartment.

Figure 3:
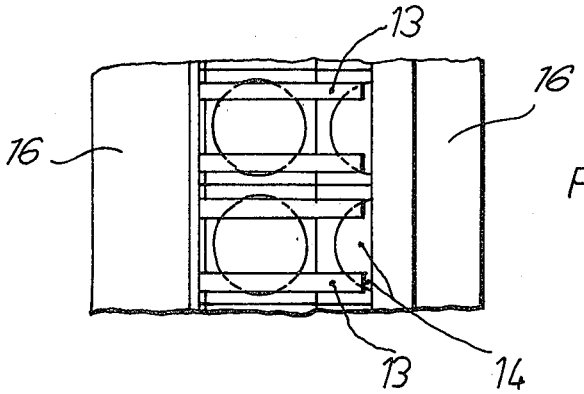
FIG. 3 is a view of the suction arrangement as seen in the direction of the arrow A in FIG. 1.

To prevent that the bottles 8 are likewise moved into the suction compartment under the influence of the aforementioned fluid stream passing through the respective cell 7 as the latter passes underneath the opening 12 of the wall means 2, a plurality of transversely spaced bars 13 are arranged in the suction compartment and extending transversely spaced from each other, as best shown in FIG. 3, over the opening 12 in the bottom portion 2' of the wall means 2 and these bars 13 are downwardly inclined, as best shown in FIG. 1, in the direction of movement of the cells 7 indicated by the arrows 6, so that the bottles 8 under the influence of the fluid stream passing through the cell 7 may slightly move upwardly under the influence of the fluid stream passing therethrough to be subsequently moved again downwardly due to the inclination of the bars 13. The bottles 8 will therefore make a slight vertical movement in the cell 7 as the latter passes the opening 12, which further facilitates detachment of the labels 3 therefrom. The bars 13 are carried, as best shown in FIG. 1, by frame means 16 which partly cover the opening 12 in the bottom portion 2' of the wall means 2, and the frame 16 is removably mounted in guides 17 connected to the wall means 2 to be withdrawn from the suction compartment and to be exchanged against other frame means with bars 13 arranged in a different manner thereon if the suction arrangement should be used in connection with different bottles 8 in the cells.

The loosened labels 3 pass of course through the discharge opening 15 into the conduit 20 and are removed before they reach the pump 21 by an arrangement not forming part of the present invention including for instance a filter and means to remove the labels accumulating on the filter in a manner similar as for instance disclosed in the copending application Ser. No. 126,391.

The bottles 8 may be inserted into the cells 7 at the horizontal upper run 5' of the conveyor means shown in FIG. 4 and discharged therefrom by gravity at the lower run 5", or be guided by appropriate guide means, not shown in the drawing and not forming part of the present invention, by the lower run 5" to a bottle-cleaning machine. On the other hand, the loaded cells 7 with precleaned bottles may arrive on the upper run 5' of the conveyor from a bottle-cleaning machine and then be discharged by gravity from the cells as they pass along the lower run 5".

The liquid in the softening container 1 and in the suction compartment defined by the wall means 2 may be heated by means not shown in the drawing, and the temperature of the liquid may be held at a maximum temperature of about 80° C.

It will be understood that each of the elements described above, or two or more together, may also find a useful application in other types of suction arrangements for removing labels from bottles differing from the types described above.

While the invention has been illustrated and described as embodied in a suction arrangement for removing labels from bottles by a stream of liquid through cells containing the bottles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a bottle-cleaning machine, a suction arrangement for removing of labels from bottles comprising a label-softening container adapted to contain a liquid and having a bottom; a plurality of elongated bottle-receiving cells having each an open end for insertion of bottles with labels into the cells and for withdrawing the bottles after the labels have been removed therefrom, said bottle-receiving cells having each opposite said open end a plurality of openings for the passage of liquid into the cells, said cells having axes and retaining the bottle in axially displaceable manner; conveyor means for transporting the cells with bottles inserted therein through said label-softening container and above its bottom; means for causing a stream of liquid from said softening container to detach and transport the labels and including wall means defining a suction compartment within said label-softening container and having a bottom portion upwardly spaced from said bottom and being formed in said bottom portion with a single opening having a width at least equal to the width of said open end of each cell as considered in the direction of movement of said cell, said conveyor means being arranged to transport said bottle-receiving cells with said open ends thereof under and closely adjacent to said bottom portion of said wall means past said single opening therein, said means for causing a stream of liquid further including means for sucking liquid from said suction compartment arranged so that a stream of liquid forcedly flows upwardly from said label-softening container via said openings of said cells through said cells, then leaves said cells through said open ends thereof, flows upwardly into said suction compartment through said opening in said bottom portion of said wall means of said suction compartment, and then is discharged into said label-softening container, whereby under the action of the suction-caused stream of liquid the labels are loosened from the bottles inside said cells, transported through said open ends of the cells into said suction compartment, and then withdrawn from the latter; and means arranged above and adjacent said cells to prevent said bottles to leave said cells through said open ends under the influence of the stream of liquid passing therethrough and tending to displace the bottles.

2. A suction arrangement as defined in claim 1, wherein and said receiving cells have outwardly extending flanges surrounding said open end and are mounted on said conveyor means so that said flanges of adjacent cells form a substantially uninterrupted surface.

3. A suction arrangement as defined in claim 2, wherein said flanges are of rectangular configuration with side edges of the flanges of each bottle-receiving cell abutting against side edges of flanges on adjacent cells.

4. A suction arrangement as defined in claim 2, wherein each of said bottle-receiving cells has an elongated cylindrical portion of a diameter greater than that of a bottle to be received therein and opposite said open end a frustoconical end portion provided with said plurality of openings.

5. A suction arrangement as defined in claim 1, wherein said means for preventing said bottles to leave through said open ends of said cells comprise a plurality of transversely spaced bars mounted in said suction compartment and extending in said transporting direction of said cells over said single opening in said wall means.

6. A suction arrangement as defined in claim 5, wherein said bars are downwardly inclined in the direction of movement of the cells.

7. A suction arrangement as defined in claim 6, and including frame means mounting said bars, said frame means with said bars being exchangeably mounted on said wall means.

* * * * *